US010770819B2

(12) United States Patent
Yamanaka

(10) Patent No.: US 10,770,819 B2
(45) Date of Patent: Sep. 8, 2020

(54) CONNECTOR

(71) Applicant: Molex, LLC, Lisle, IL (US)

(72) Inventor: Manabu Yamanaka, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/229,842

(22) Filed: Dec. 21, 2018

(65) Prior Publication Data

US 2019/0199030 A1 Jun. 27, 2019

(30) Foreign Application Priority Data

Dec. 26, 2017 (JP) ..... 2017-249059

(51) Int. Cl.

| | |
|---|---|
| ***H01R 13/41*** | (2006.01) |
| ***H01R 43/16*** | (2006.01) |
| ***H01R 43/20*** | (2006.01) |
| ***H01R 13/405*** | (2006.01) |
| ***H01R 12/58*** | (2011.01) |
| ***H01R 43/24*** | (2006.01) |

(52) U.S. Cl.

CPC ..... *H01R 13/41* (2013.01); *H01R 13/405* (2013.01); *H01R 43/16* (2013.01); *H01R 43/20* (2013.01); *H01R 12/58* (2013.01); *H01R 43/24* (2013.01)

(58) Field of Classification Search

CPC ..... H01R 12/58; H01R 43/18; H01R 43/24; H01R 13/50; H01R 13/502; H01R 13/41; H01R 13/405; H01R 43/16; H01R 13/514; H01R 13/504

See application file for complete search history.

(56) References Cited

U.S. PATENT DOCUMENTS

| | | | | | |
|---|---|---|---|---|---|
| 5,080,596 | A * | 1/1992 | Viselli | H01R 12/724 | 439/79 |
| 5,252,080 | A * | 10/1993 | Pesson | H01R 12/712 | 439/79 |
| 5,266,038 | A * | 11/1993 | Nakamura | H01R 13/432 | 439/607.06 |
| 5,281,169 | A * | 1/1994 | Kiat | H01R 12/712 | 439/607.35 |

(Continued)

FOREIGN PATENT DOCUMENTS

| | | | |
|---|---|---|---|
| JP | 2002-042935 | A | 2/2002 |
| TW | 414374 | U | 12/2000 |
| TW | M405668 | U | 6/2011 |

*Primary Examiner* — Briggitte R. Hammond

(74) *Attorney, Agent, or Firm* — Molex, LLC

(57) ABSTRACT

Provided is a low-cost and high-reliability connector in which a guide member integrally formed with a housing guides a leg part of a terminal so that the position of the leg part of the terminal can be stabilized with a simple configuration. A connector includes a housing; terminals that include leg parts to be connected to a board, and are integrally formed with the housing; and guide members that are integrally formed with the housing and guide the leg parts. The leg parts each include: a horizontal part that protrudes toward a back side from the housing; a vertical part with a part around a distal end to be connected to the board; and a curved part through which the horizontal part and the vertical part are connected with each other. A gap is provided between a back surface of the guide member and a front surface of the vertical part.

8 Claims, 15 Drawing Sheets

(56) References Cited

U.S. PATENT DOCUMENTS

| | | | | |
|---|---|---|---|---|
| 5,453,016 | A * | 9/1995 | Clark | H01R 43/205 439/79 |
| 5,779,489 | A * | 7/1998 | Davis | H01R 13/7031 439/79 |
| 6,186,830 | B1 * | 2/2001 | Lin | H01R 13/6594 439/607.4 |
| 6,767,224 | B2 * | 7/2004 | Wu | H01R 24/64 439/374 |
| 6,814,612 | B1 * | 11/2004 | Hu | H01R 13/6595 439/541.5 |
| 7,722,366 | B2 * | 5/2010 | Yamamoto | H01R 12/58 439/79 |
| 7,938,651 | B2 * | 5/2011 | Hanyu | H01R 12/58 439/541.5 |
| 9,263,833 | B2 * | 2/2016 | Cheng | H01R 12/724 |

* cited by examiner

FIG. 8A
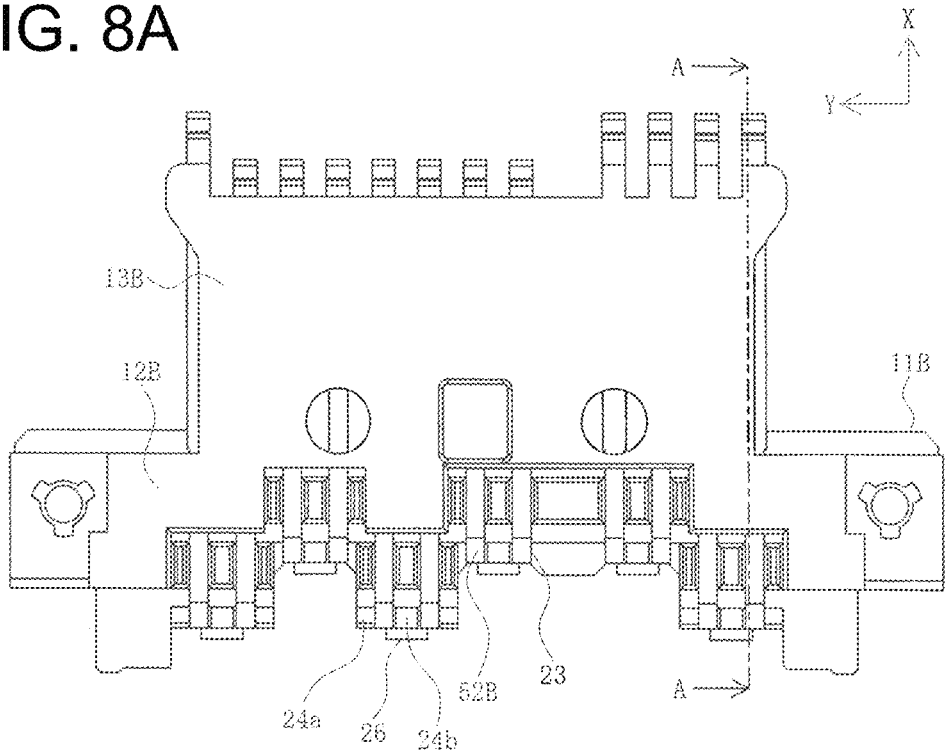
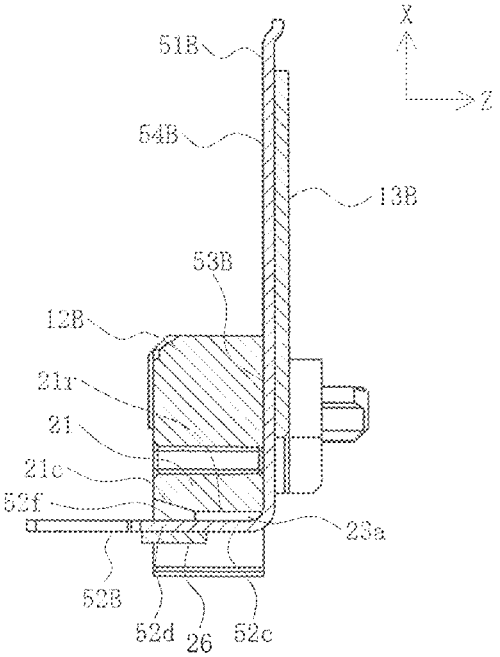
FIG. 8B

FIG. 11A
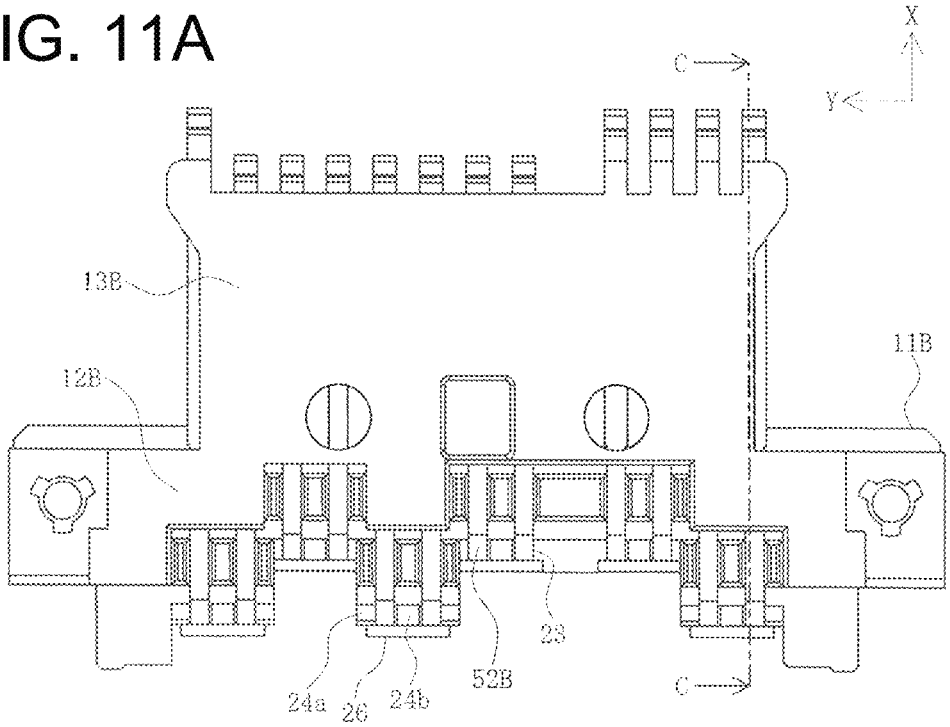
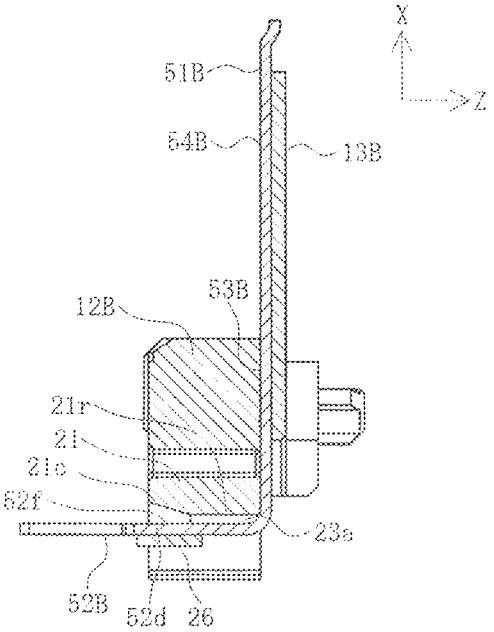
FIG. 11B

CONNECTOR

RELATED APPLICATIONS

This application claims priority to Japanese Application No. 2017-249059, filed Dec. 26, 2017, which is incorporated herein by reference in its entirety.

TECHNICAL FIELD

The present disclosure relates to a connector.

BACKGROUND ART

A conventional board connector is mounted on a board such as a printed circuit board and is used for connecting to a cable or the like. Such a board connector includes a plurality of L shaped terminals that protrude toward a back side of a connector main body and a guide plate that guides the terminals (see, for example, Patent Document 1).

FIG. 15 is a perspective view illustrating a conventional board connector as viewed from the back side.

In the figure, 811 denotes a housing made of an insulating material such as synthetic resin. A plurality of terminals 851, made of a conductive material such as metal, are attached to the housing 811. The terminals 851 are each an L shaped terminal that protrudes toward the back side from a back wall of the housing 811, and are each bent at approximately 90 degrees as a whole, to have a leg part 852 extending downward. The leg part 852 has a distal end, that is, a lower end connected by soldering and the like while being inserted into a through hole formed in an unillustrated circuit board.

The leg part 852 of each of the terminals 851 is long and thus is likely to deform upon being affected by external force such as vibrations. Thus, a guide plate 841 is attached to the housing 811, and the leg part 852 of each of the terminals 851 is inserted into a guide hole 842 formed in the guide plate 841, so that the displacement of the leg part 852 can be prevented.

This configuration ensures the prevention of the displacement of the leg part 852 of each of the terminals 851 and thus ensures a stable position of the lower end of the leg part 852. Thus, the lower ends of the plurality of leg parts 852 can be inserted into the through holes formed in the circuit board at once, whereby the board connector can be mounted to the circuit board easily.

Patent Document 1: Japanese Unexamined Patent Application Publication No. 2002-042935

SUMMARY

The conventional connector has the guide plate 841 manufactured separately from the housing 811 and attached to the housing 811. This leads to an increase in the number of parts as well as the number of assembly steps for the connector, resulting in a higher manufacturing cost.

An object herein is to solve the problem of the conventional connector. Specifically, a low-cost and high-reliability connector in which a guide member integrally formed with a housing guides a leg part of a terminal so that the position of the leg part of the terminal can be stabilized with a simple configuration.

To achieve this, a connector includes a housing; terminals that include leg parts to be connected to a board, and are integrally formed with the housing; and guide members that are integrally formed with the housing and guide the leg parts. The leg parts each include: a horizontal part that protrudes toward a back side from the housing; a vertical part having a part around a distal end to be connected to the board; and a curved part through which the horizontal part and the vertical part are connected with each other. A gap is provided between a back surface of the guide member and a front surface of the vertical part.

In another connector, an inclined part along which the gap increases toward a lower side is formed on the back surface.

In yet another connector, the guide members include guide walls that protrude toward the back side from the back surface, and the vertical part is accommodated in a guide groove between adjacent ones of the guide walls.

In still another connector, the vertical part is not in contact with at least one of the guide walls on both sides of the guide groove.

In still another connector, the guide members each include a guide plate that overlaps with at least a part of the back surface of the vertical part, and prevents displacement of the vertical part toward the back side.

In still another connector, the guide plate is integrally connected to one of the guide walls on both sides of the guide groove.

In still another connector, the guide members are integrally connected to both of the guide walls on both sides of the guide groove.

A connector assembly includes the connector according to the present disclosure, and a mating connector including a mating terminal to be connected to the terminals.

A method for manufacturing a connector including: a housing; terminals that include leg parts to be connected to a board, and are integrally formed with the housing; and guide members that are integrally formed with the housing and guide the leg parts.

The method includes the steps of: performing bending on the leg parts to form curved parts connected to back ends of horizontal parts protruding toward a back side from the housing so that vertical parts connected to the back ends of the curved parts extend toward a lower side; accommodating each of the vertical parts in a guide groove between adjacent guide walls protruding toward the back side from back surfaces of the guide members; and performing shaping on one of the guide walls on both sides of the guide groove and forming a guide plate that is integrally connected to the guide walls and overlaps with at least a part of a back surface of the vertical part.

According to the present disclosure, a connector has a guide member, which is integrally formed with a housing, to guide a leg part of a terminal. Thus, a simple configuration can guarantee stabilization of the position of the leg portion, as well as cost reduction and higher reliability.

BRIEF DESCRIPTION OF THE DRAWINGS

FIGS. 8A and 8B are first two views illustrating the state after the shaping is performed on the guide member of the lower side housing according to the first embodiment, and FIG. 8A is a top view and FIG. 8B is a cross-sectional view in a direction of arrow A-A in FIG. 8A.

FIG. 9A is a back view and FIG. 9B is a cross-sectional view in a direction of arrow B-B in FIG. 9A.

FIGS. 11A and 11B are first two views illustrating the state after the shaping is performed on the guide member of the lower side housing according to the first embodiment, and FIG. 11A is a top view and FIG. 11B is a cross-sectional view in a direction of arrow C-C in FIG. 11A.

FIG. 12A is a back view and FIG. 12B is a cross-sectional view in a direction of arrow D-D in FIG. 12A.

FIG. 13A is a perspective view as viewed from the front side and FIG. 13B is a perspective view as viewed from the back side.

FIG. 14A is a top view and FIG. 14B is a cross-sectional view in a direction of arrow E-E in FIG. 14A.

DETAILED DESCRIPTION OF THE PREFERRED EMBODIMENTS

Embodiments will be described in detail below with reference to drawings.

Figure 1:
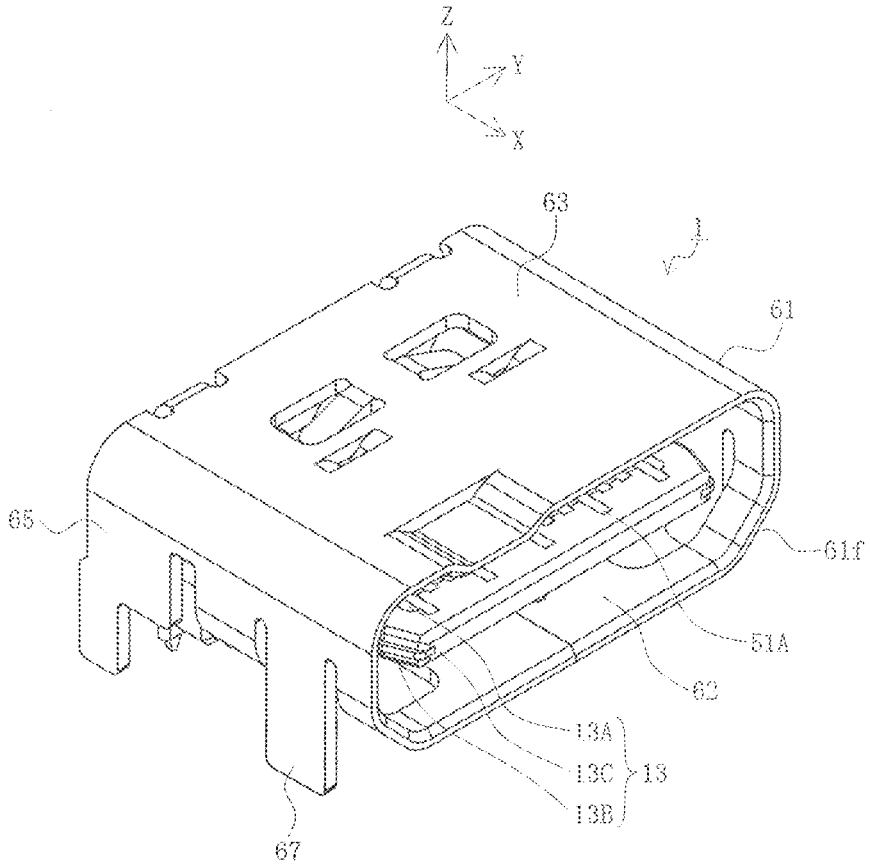
FIG. 1 is a first perspective view of a connector according to a first embodiment.
Figure 2:
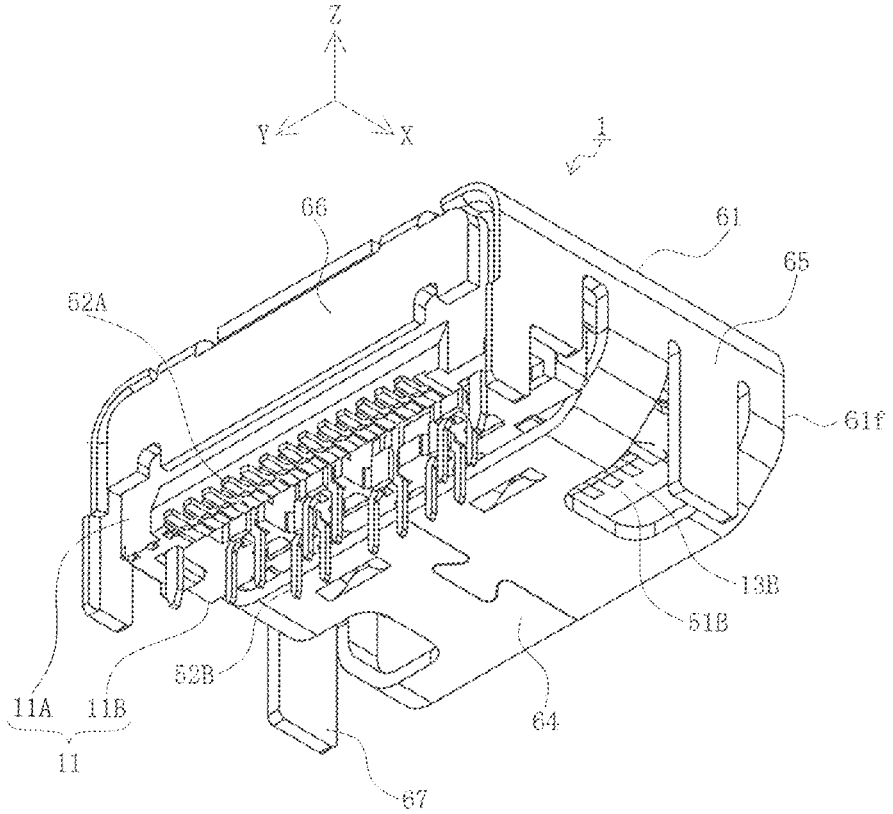
FIG. 2 is a second perspective view of a connector according to the first embodiment.
Figure 3:
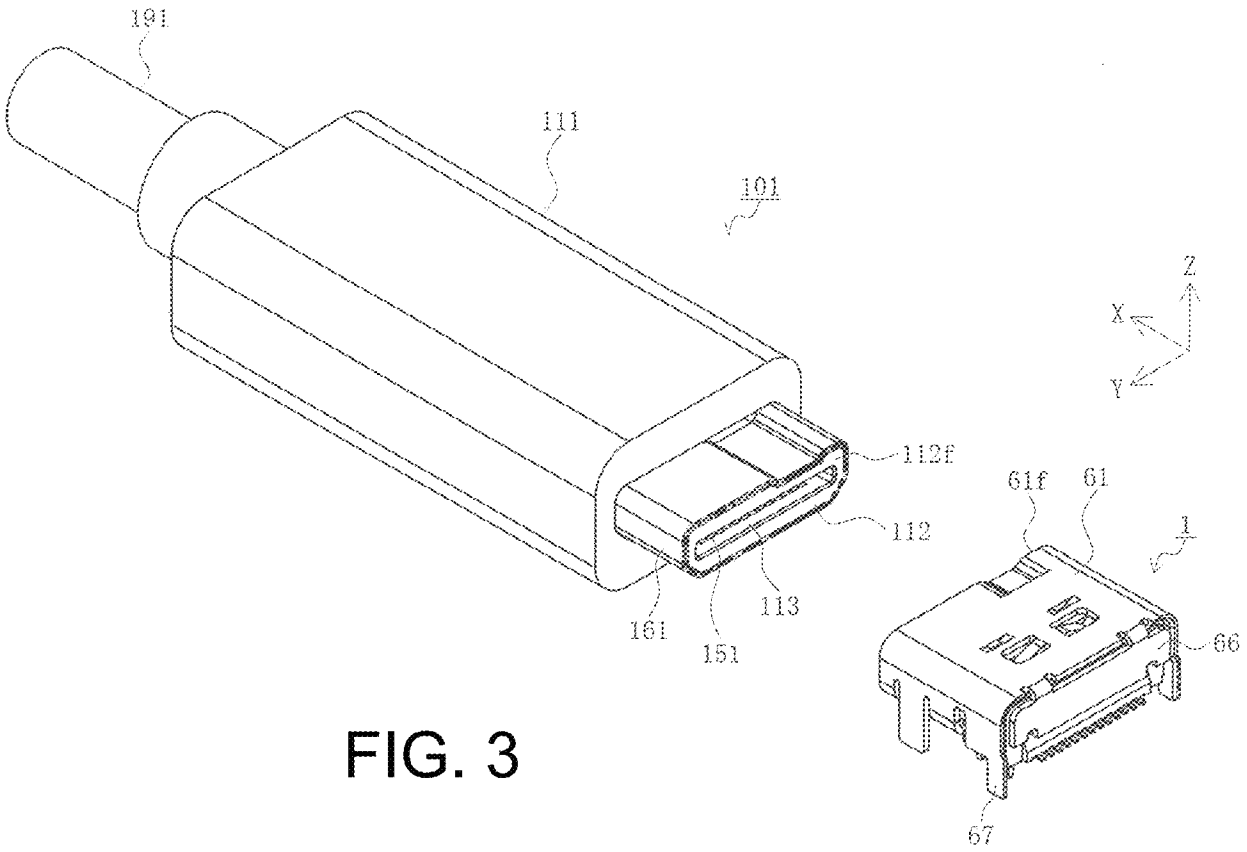
FIG. 3 is a perspective view illustrating a state before the connector according to the first embodiment and a mating connector are mated.

FIG. 1 is a first perspective view of a connector according to a first embodiment. FIG. 2 is a second perspective view of a connector according to the first embodiment. FIG. 3 is a perspective view illustrating a state before the connector according to the first embodiment and a mating connector are mated.

In the figures, 1 denotes a connector according to the present embodiment that is one of a pair of connectors serving as a connector assembly. Preferably, the connector 1 is a board connector, and is mounted to an electric or electronic device such as a personal computer, a smartphone, a tablet terminal, a video camera, a music player, or a game device via an unillustrated board. These devices are examples, and the connector 1 may be mounted to any type of devices.

Furthermore, 101 denotes a mating connector that is the other one of the pair of connectors serving as a connector assembly and that mates with the connector 1. In the illustrated example, the mating connector 101 is a cable connector connected to a distal end of a cable 191, but is not necessarily limited to the cable connector, and may be any type of connector including a board connector mounted to a board, or may be a card edge connector mounted to an end part of a card, for example.

Note that expressions for indicating directions such as up, down, left, right, front, and back, used to describe the operations and configurations of the parts of the connector 1 and the mating connector 101 in the present embodiment are not absolute but rather relative directions, and though appropriate when the parts of the connector 1 and the mating connector 101 are in the positions illustrated in the figures, these directions should be interpreted differently when these positions change, in order to correspond to the change.

The connector 1 includes an upper side terminal 51A that is a terminal arranged on the upper side and a lower side terminal 51B that is a terminal arranged on the lower side of the upper side terminal 51A. Further, the connector 1 includes an upper side housing 11A that is a housing serving as a connector main body that holds the upper side terminal 51A, and a lower side housing 11B that is a housing serving as a connector main body that holds the lower side terminal 51B. The the upper side housing 11A is integrally molded with the upper side terminal 51A by over-molding (insert molding), and the lower side housing 11B is integrally molded with the lower side terminal 51B by over-molding. In the description below, the upper side terminal 51A and the lower side terminal 51B may be collectively referred to as a terminal 51, and the upper side housing 11A and the lower side housing 11B may be collectively referred to as a housing 11.

The upper side terminal 51A is a member integrally formed by performing a process such as punching or bending on a conductive metal plate, and includes tail parts 52A that are board connection parts exposed on the lower side of the upper side housing 11A, and surface-mounted on a connection pad formed on a surface of the unillustrated board by soldering. The tail parts 52A are formed to be bent by approximately 90 degrees at a part close to a lower surface of the upper side housing 11A, to protrude toward the back side (negative X axis direction), and have lower surfaces connected to the connection pad by soldering while being in contact with or being in the vicinity of the connection pad. The upper side housing 11A includes an upper side tongue part 13A extending in a front and back direction (X axis direction) and a width direction (Y axis direction) of the connector 1, and a part of the upper side terminal 51A to be in contact with the mating terminal 151 of the mating connector 101 is embedded in the upper side tongue part 13A while having the upper surface exposed on the upper surface of the upper side tongue part 13A.

The lower side terminal 51B is a member integrally formed by performing a process such as punching or bending on a conductive metal plate, and includes leg parts 52B that protrude downward (negative Z axis direction) from the lower side housing 11B to be exposed, and serve as board connection parts mounted by soldering while having their distal ends (lower ends) inserted into through holes formed on a surface of the unillustrated board. The leg parts 52B are each bent by approximately 90 degrees at a part close to the back end of the lower side housing 11B to protrude downward, and is soldered so that the connection is established while having a lower end inserted in the through hole. The lower side housing 11B includes a lower side tongue part 13B that extends in the front and back direction and the width direction of the connector 1. A part of the lower side terminal 51B to be in contact with the mating terminal 151 of the mating connector 101 is embedded in the lower side tongue part 13B while having a lower surface exposed on a lower surface of the lower side tongue part 13B.

The upper side housing 11A and the lower side housing 11B are accommodated in a shell 61 made of a metal plate while being in a combined state. When the upper side housing 11A and the lower side housing 11B are combined, the upper side tongue part 13A and the lower side tongue part 13B are combined with a tongue part coupling part 13C, whereby a tongue part 13 having a thick plate shape is formed. On the upper surface of the tongue part 13, the part to be in contact with the mating terminal 151 of the upper side terminal 51A, arranged on the upper surface, is exposed. On the lower surface, the part to be in contact with the mating terminal 151 of the lower side terminal 51B, arranged on the lower side, is exposed. The tail parts 52A of the upper side terminal 51A are arranged on the back side of the leg parts 52B of the lower side terminals 51B, to be aligned along the width direction of the connector 1.

In the illustrated example, the shell 61 includes a top plate part 63, a bottom plate part 64, a pair of side plate parts 65, and a back plate part 66, to surround all the surfaces of the housing 11 except for the surface on a side to be mated with the mating connector 101, that is, the front surface, is connected to the ground line of the unillustrated board via an attachment leg part 67 protruding toward the lower side from the side plate part 65, and shields the connector 1. The top plate part 63, the bottom plate part 64, the pair of side plate parts 65, and the back plate part 66 define a circumference of an inner cavity 62 open at a front end 61*f* of the shell 61 to function as an insertion recess into which a protruding part 112 of the mating connector 101 is inserted.

The mating connector 101 includes a mating housing 111 having a rectangular parallelepiped shape, the protruding part 112 protruding toward the front side (negative X axis direction) from the mating housing 111, and a mating shell 161 that surrounds a circumference of the protruding part 112. The protruding part 112 includes a terminal accommodating recess 113 that is open at a front end 112*f* of the protruding part 112. Mating terminals 151 are arranged along the width direction (Y axis direction) of the mating connector 101, on upper and lower inner surfaces of the terminal accommodating recess 113. The mating housing 111 has a back end connected with the cable 191 including a plurality of unillustrated power lines.

The connector 1 and the mating connector 101 are mated with each other in the following manner. Specifically, the orientations of the connector 1 and the mating connector 101 are controlled so that the front end 61*f* of the shell 61 and the front end 112*f* of the protruding part 112 face each other as illustrated in FIG. 3. Then, the mating connector 101 is relatively moved toward the connector 1 so that the protruding part 112 is inserted into the inner cavity 62. In this process, the tongue part 13 provided in the inner cavity 62 is inserted into the terminal accommodating recess 113, and the terminals 51 exposed on the upper and the lower surfaces of the tongue part 13 each come into contact with a corresponding one of the mating terminals 151 exposed on the inner surface of the terminal accommodating recess 113, whereby electric conduction is established. In this manner, the connector 1 and the mating connector 101 are mated with each other and connected with each other.

Next, a configuration of the lower side housing 11B and the lower side terminal 51B of the connector 1 is described.

Figure 4:
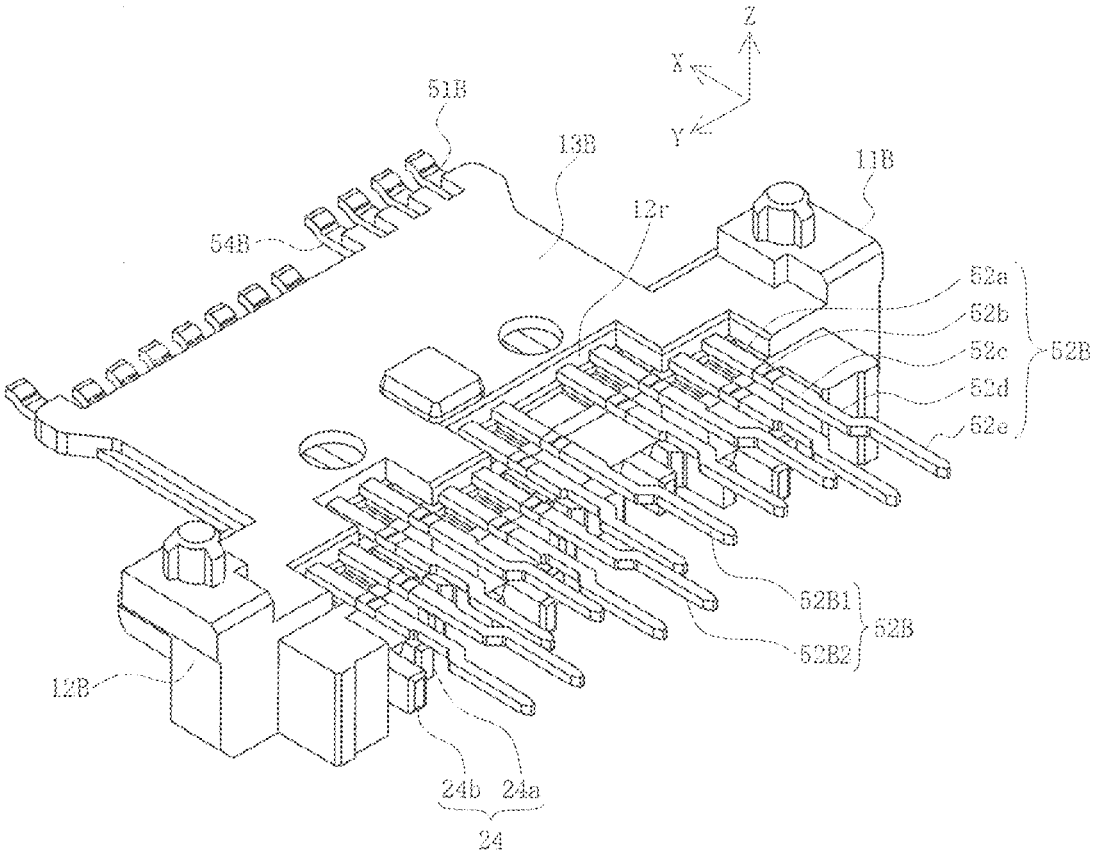
FIG. 4 is a perspective view illustrating a state before bending is performed on a leg part of a lower side terminal according to the first embodiment.
Figure 5:
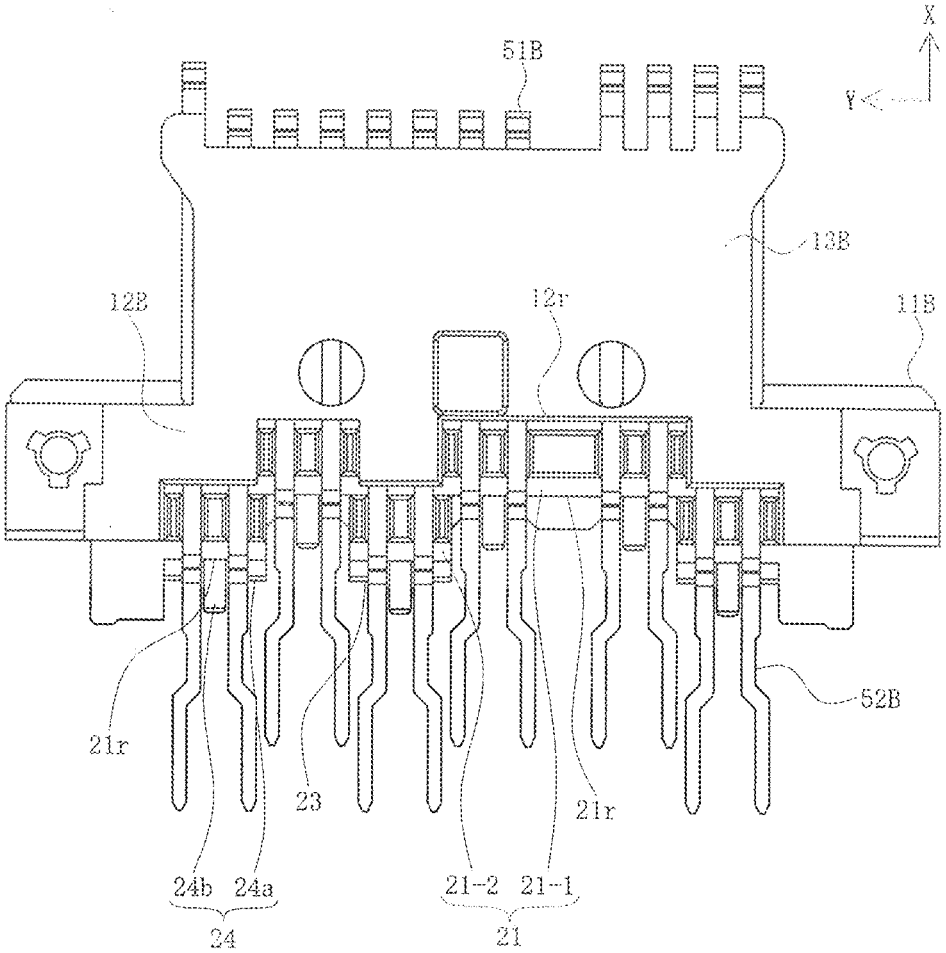
FIG. 5 is a top view illustrating the state before the bending is performed on the leg part of the lower side terminal according to the first embodiment.
Figure 6:
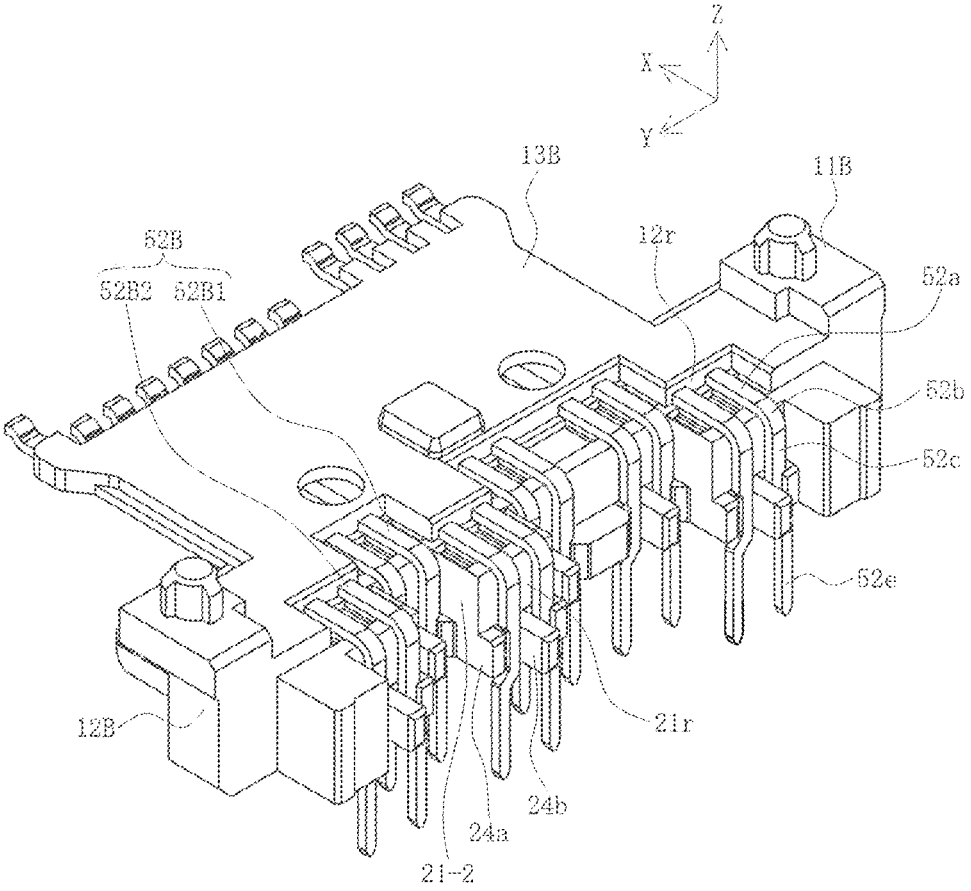
FIG. 6 is a perspective view illustrating a state after the bending is performed on the leg part of the lower side terminal according to the first embodiment.
Figure 7:
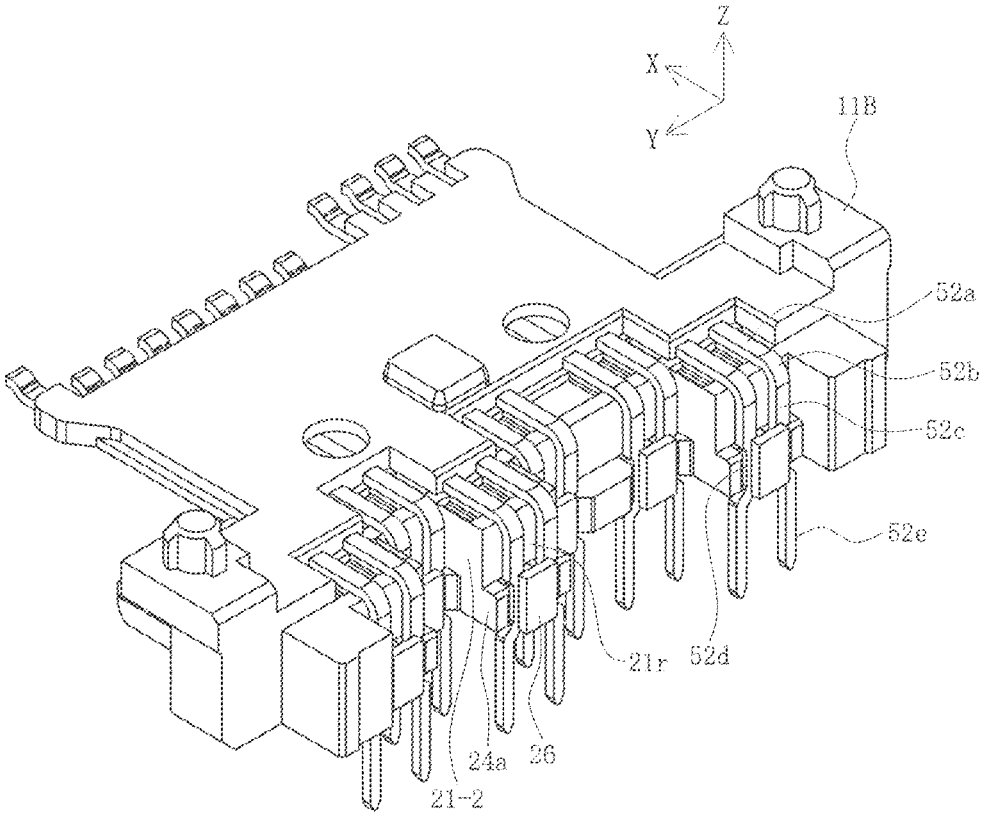
FIG. 7 is a perspective view illustrating a state after shaping is performed on a guide member of the lower side housing according to the first embodiment.
Figure 9A:
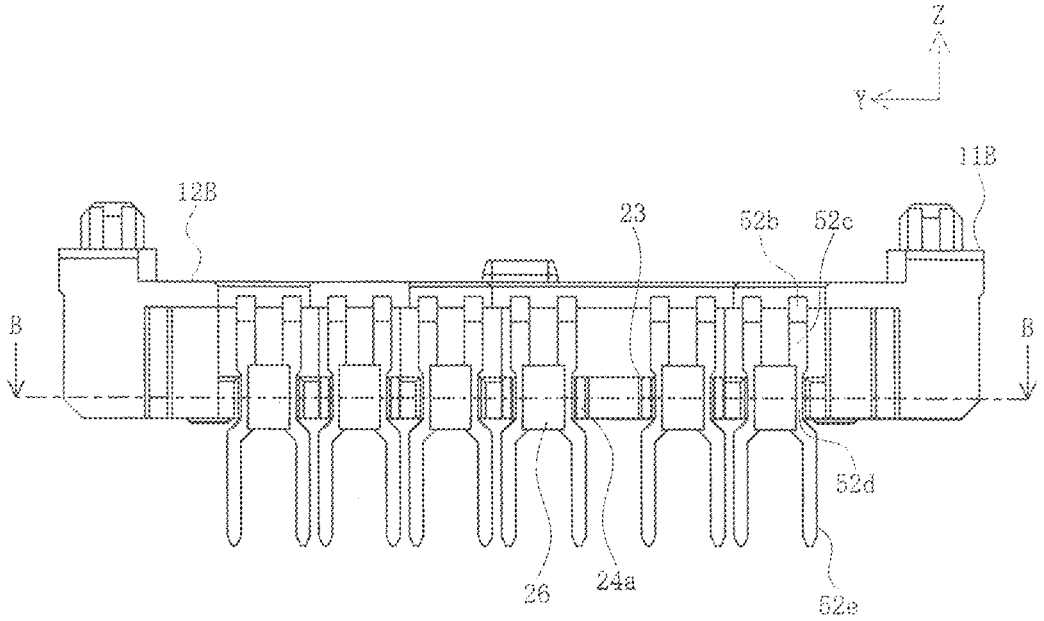
FIGS. 9A and 9B are second two views illustrating the state after the shaping is performed on the guide member of the lower side housing according to the first embodiment.
Figure 9B:
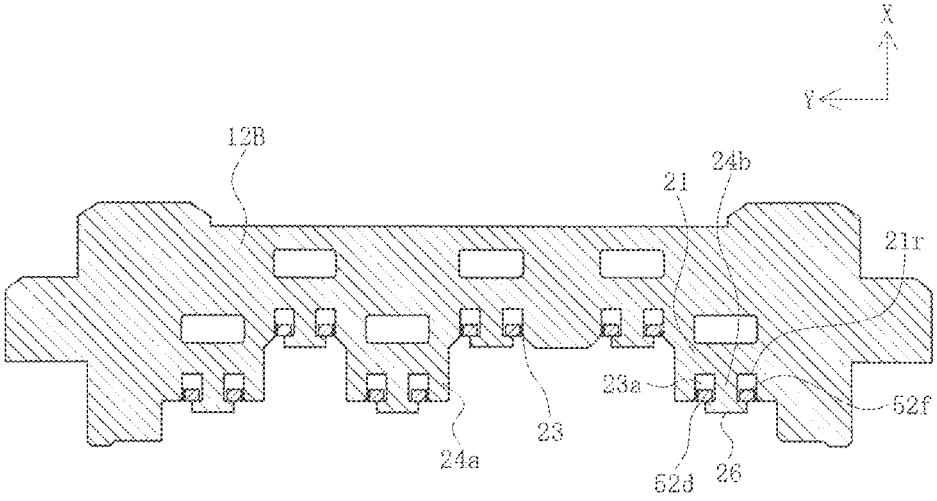

FIG. 4 is a perspective view illustrating a state before bending is performed on a leg part of a lower side terminal according to the first embodiment. FIG. 5 is a top view illustrating the state before the bending is performed on the leg part of the lower side terminal according to the first embodiment. FIG. 6 is a perspective view illustrating a state after the bending is performed on the leg part of the lower side terminal according to the first embodiment. FIG. 7 is a perspective view illustrating a state after shaping is performed on a guide member of the lower side housing according to the first embodiment. FIGS. 8A and 8B illustrate first two views illustrating the state after the shaping is performed on the guide member of the lower side housing according to the first embodiment. FIGS. 9A and 9B illustrate second two views illustrating the state after the shaping is performed on the guide member of the lower side housing according to the first embodiment. Note, FIG. 8A is a top view and FIG. 8B is a cross-sectional view in a direction of arrow A-A in FIG. 8A, and FIG. 9A is a back view and FIG. 9B is a cross-sectional view in a direction of arrow B-B in FIG. 9A.

As illustrated in FIG. 8B, the lower side terminal 51B includes a main body part 53B, a contact part 54B connected to the front end of the main body part 53B, and a leg part 52B connected to a back end of the main body part 53B. When the lower side housing 11B is integrally formed with the lower side terminal 51B by over-molding, the main body part 53B is embedded in and held by a terminal holding part 12B of the lower side housing 11B. The contact part 54B is embedded in the lower side tongue part 13B while having at least the lower surface (surface on the negative Z axis direction side) exposed on the lower surface of the lower side tongue part 13B of the lower housing 11B. A part around the front end of the contact part 54B may protrude toward the front side (positive X axis direction side) beyond the front end of the lower side tongue part 13B.

In a state immediately after the lower side housing 11B has been integrally molded with the lower side terminal 51B, the leg part 52B linearly protrudes toward the back side from the back end 12*r* of the terminal holding part 12B, as illustrated in FIGS. 4 and 5. The leg part 52B includes a horizontal part 52*a* that is colinearly poisoned with respect to the main body part 53B, a curved part 52*b* curved by approximately 90 degrees by the bending, and a vertical part 52*c* that extends in an upper and lower direction (Z axis direction) as a result of forming the curved part 52*b*. In the present embodiment, "curved" essentially indicates that the leg part 52B is partially bent so that the horizontal part 52*a* and the vertical part 52*c* are provided, and includes bending to achieve an arch shaped side surface and bending to achieve an angular shaped side surface. The vertical part 52*c* includes a constricted part 52*d* formed to be thin, and a downward protruding part 52*e* that is a part around a distal end of the vertical part 52*c* and is connected to the unillustrated board.

The back end 12*r* of the terminal holding part 12B has recesses and protrusions in a plan view, and the horizontal part 52*a* of the leg part 52B protrudes toward the back side from each of parts recessed toward the front side and parts protruding toward the back side. The leg part 52B protruding from the part of the back end 12*r* recessed toward the front side is referred to as a front side leg part 52B1. The leg part 52B protruding from the part of the back end 12*r* protruding toward the back side is referred to as a back side leg part 52B2. The front side leg part 52B1 and the back side leg part 52B2 may be collectively referred to as a leg part 52B.

The front side leg part 52B1 and the back side leg part 52B2 are equal to each other in the entire length, and are equal to each other in the lengths of the horizontal part 52*a*, the curved part 52*b*, and the vertical part 52*c* thereof, as well as in the lengths of the constricted part 52*d* and the downward protruding part 52*e* of the vertical part 52*c*. Thus, as illustrated in FIG. 6, when the curved part 52*b* is formed, the vertical parts 52*c*, more on the lower side than the curved parts 52*b* in the front side leg parts 52B1, are aligned on a relatively front side in the width direction of the connector 1. The vertical parts 52*c*, more on the lower side than the curved parts 52*b* in the back side leg parts 52B2, are aligned in the width direction of the connector 1 while being more on the back side than the vertical parts 52*c* in the front side leg part 52B1. Thus, a total of two rows are formed. The vertical parts 52*c* of the leg parts 52B are not necessarily limited to the configuration of forming the two rows, and may be configured to form a single row or a three or more rows.

The terminal holding part 12B includes guide members 21 that protrude toward the back side from the back end 12*r*. The guide member 21 protruding from the part of the back end 12*r* recessed toward the front side is referred to as a front side guide member 21-1. The guide member 21 protruding from the part of the back end 12*r* protruding toward the back side is referred to as a back side guide member 21-2. The front side guide member 21-1 and the back side guide member 21-2 may be collectively referred to as the guide member 21. The guide member 21 is integrally formed with the lower side housing 11B, and has a lower surface, which is at a lowermost position of the lower side housing 11B, in contact with or arranged in the vicinity of the surface of the unillustrated board, in a state where the connector 1 is mounted on the surface.

The guide member 21 includes guide walls 24 having a thick plate shape protruding toward the back side from the back surface 21*r* extending in an upper and lower direction, and a guide groove 23 that is formed between adjacent guide walls 24 and is recessed toward the front side beyond the back end of the guide wall 24. In the illustrated example, the lower side terminals 51B are arranged so that two of them form a single set of terminals. The guide walls 24 includes walls (referred to as outer side guide walls 24*a*) positioned on both left and right sides of a set of two leg parts 52B and a wall (referred to as an inner side guide wall 24*b*) positioned between each set of two leg parts 52B. The inner side guide wall 24*b* has an amount of protrusion toward the back side larger than that of the outer side guide wall 24*a*. The outer side guide wall 24*a* and the inner side guide wall 24*b* may be collectively referred to as the guide wall 24.

Bending is performed on the leg part 52B linearly protruding toward the back side from the back end 12*r* of the terminal holding part 12B, so that the curved part 52*b* is formed by approximately 90 degrees to make the vertical part 52*c* extend vertically downward. As a result, as illustrated in FIG. 6, the vertical part 52*c* extends downward along the back surface 21*r* of the guide member 21, and the constricted part 52*d* is provided at the position corresponding to the guide groove 23 formed between the guide walls 24. When the constricted part 52*d* is accommodated in the guide groove 23, the downward protruding part 52*e* protrudes toward the lower side beyond the lower surface of the guide member 21. With the constricted part 52*d* thus accommodated in the guide groove 23, the guide walls 24 on the both left and right sides prevent the displacement of the constricted part 52*d* in the width direction of the connector 1. As a result, the displacement of the vertical part 52*c* in the width direction of the connector 1 is prevented. The constricted part 52*d* may have both left and right side surfaces being in contact with side surfaces of both left and right guide walls 24, or being in the vicinity of the side surfaces with slight gaps in between, instead of being in contact with the side surfaces.

Next, shaping is performed on the guide member 21. Specifically, the back end part of the inner side guide wall 24*b*, protruding toward the back side beyond the back surface of the vertical part 52*c* with the constricted part 52*d* accommodated in the guide groove 23, is plastically deformed by applying heat or pressure. As a result, the back side guide wall 26 serving as the guide plate is formed as illustrated in FIGS. 7 to 9B. The back side guide wall 26 is formed by extending the back end part of the inner side guide wall 24*b* toward both sides in the width direction of the connector 1, to protrude toward the left and right adjacent outer side guide walls 24*a* from both left and right side surfaces of the inner side guide wall 24*b*, and thus forms a substantially anchor or mushroom shape in a plan view. The parts of the back side guide wall 26 that protrude from both left and right side surfaces of the inner side guide wall 24*b* overlap with at least a part of the back surface of the constricted part 52*d* in the width direction of the connector 1. Thus, displacement of the constricted part 52*d* toward the back side is prevented, whereby displacement of the vertical part 52*c* toward the back side is prevented. Specifically, the parts of the back side guide wall 26 protruding from both left and right surfaces of the inner side guide wall 24*b* are in contact with at least a part of the back surface of the constricted part 52*d*. Gaps are provided between both left and right ends of the back side guide wall 26 and the left and right adjacent outer side guide walls 24*a*. Thus, both left and right ends of the back side guide wall 26 are not in contact with the left and right adjacent outer side guide walls 24*a*.

As illustrated in FIGS. 8B and 9B, a gap 23*a* is provided on the front side of the constricted part 52*d*, in the guide groove 23. Specifically, the gap 23*a* is provided between the back surface 21*r* of the guide member 21 and the front surface 52*f* of the vertical part 52*c* of the leg part 52B, and thus the front surface 52*f* of the vertical part 52*c* is separated from the back surface 21*r* of the guide member 21. An inclined part 21*c*, inclined toward the front side, is formed in a lower end part of the back surface 21*r* of the guide member 21, and thus the distance from the front surface 52*f* of the vertical part 52*c* increases toward the lower side.

As described above, the gap 23*a* is provided between the back surface 21*r* of the guide member 21 and the front surface 52*f* of the vertical part 52*c* of the leg part 52B, and the inclined part 21*c* is formed in the lower end part of the back surface 21*r*. Thus, the vertical part 52*c*, more on the lower side than the lower end of the curved part 52*b* of the leg part 52B can be displaced toward the front side when forming the curved part 52*b* curved by approximately 90 degrees by performing bending on the leg part 52B, considering spring back of the leg part 52B made of metal. Thus, the bending can be accurately performed to form the curved part 52*b* curved at an angle of approximately 90 degrees, even when the spring back occurs.

Next, a modification of the guide member 21 after the shaping is described.

Figure 10:
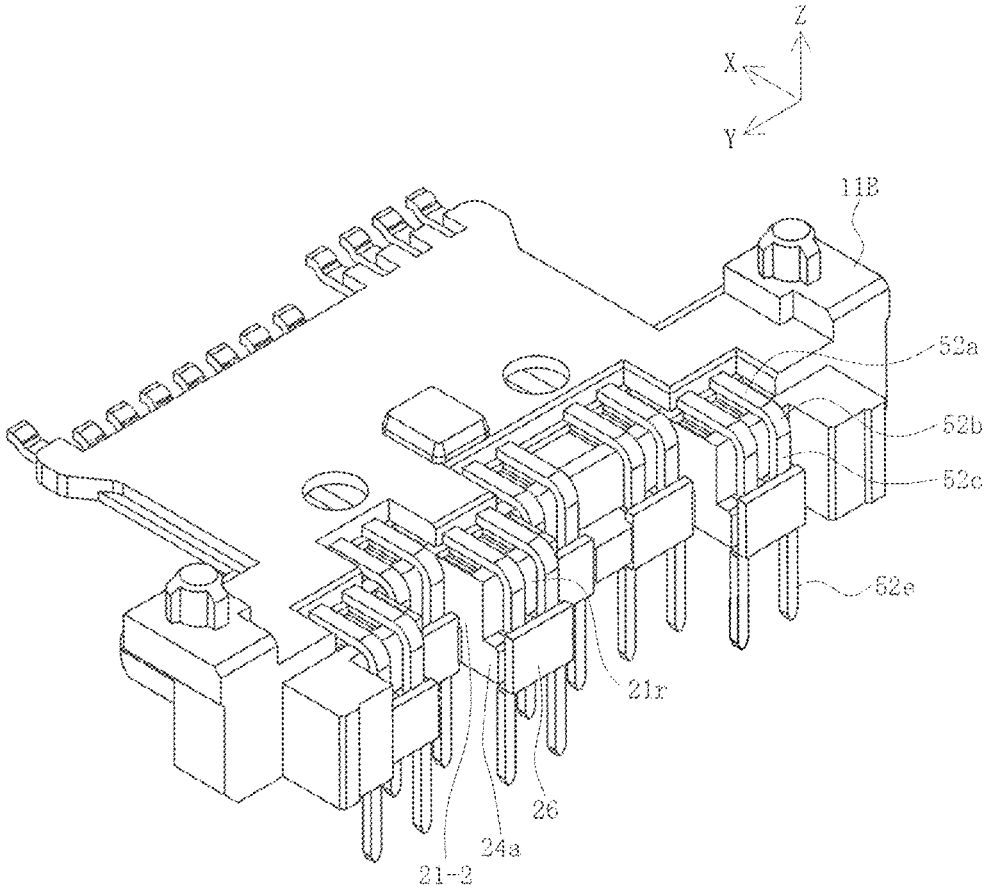
FIG. 10 is a perspective view illustrating a modification of the state after the shaping is performed on the guide member of the lower side housing according to the first embodiment.
Figure 12A:
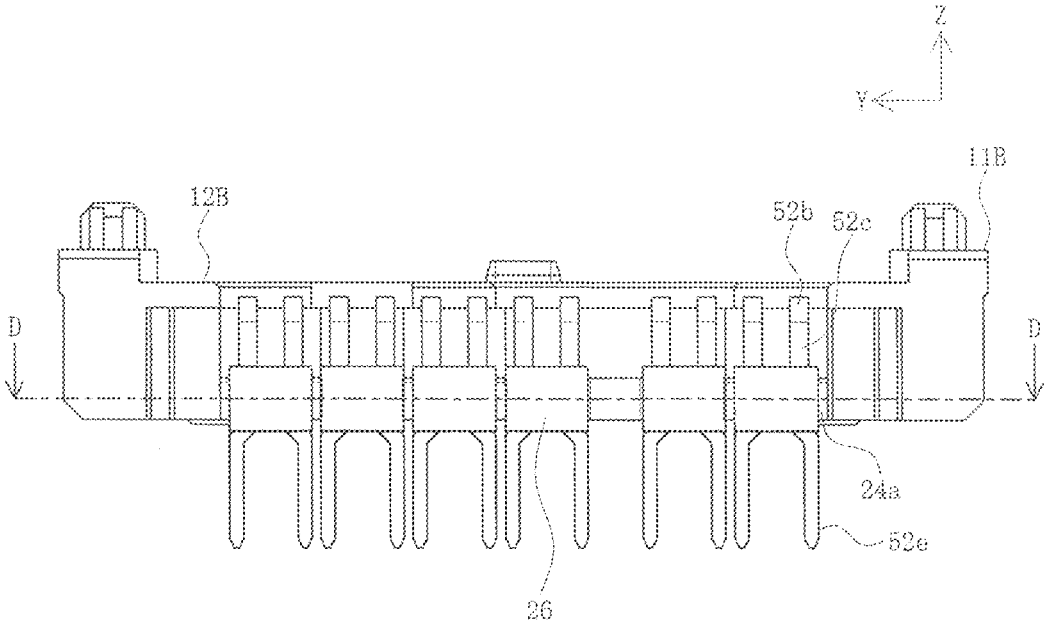
FIGS. 12A and 12B are second two views illustrating the state after the shaping is performed on the guide member of the lower side housing according to the first embodiment.
Figure 12B:
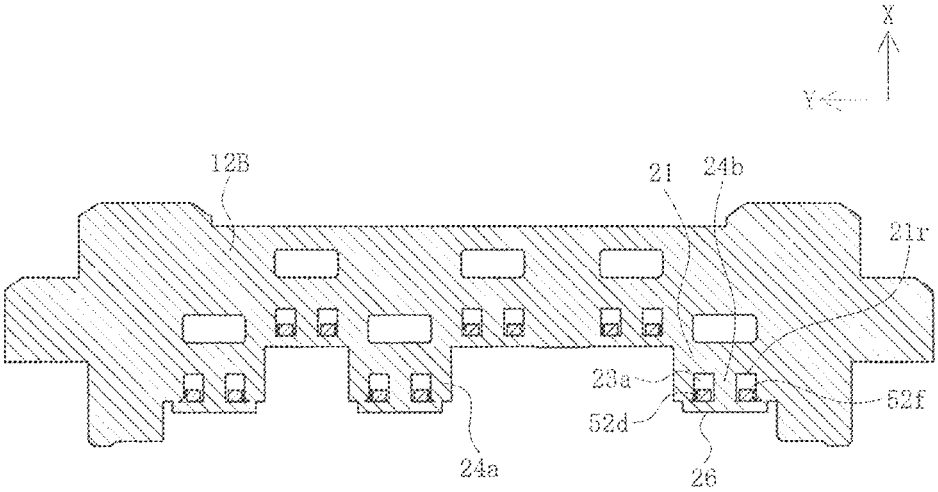

FIG. 10 is a perspective view illustrating a modification of the state after the shaping is performed on the guide member of the lower side housing according to the first embodiment. FIGS. 11A and 11B illustrate first two views illustrating the state after the shaping is performed on the guide member of the lower side housing according to the first embodiment. FIGS. 12A and 12B illustrate second two views illustrating the state after the shaping is performed on the guide member of the lower side housing according to the first embodiment.

Note, FIG. 11A is a top view and FIG. 11B is a cross-sectional view in a direction of arrow C-C in FIG. 11A, and FIG. 12A is a back view and FIG. 12B is a cross-sectional view in a direction of arrow D-D in FIG. 12A.

In this modification, a back end part of the inner side guide wall 24*b*, protruding toward the back side beyond the back surface of the constricted part 52*d* accommodated in the guide groove 23, is plastically deformed by applying heat or pressure for example, so that a back side guide wall 26 as illustrated in FIGS. 10 to 12B is formed. Specifically, both left and right ends of the back side guide wall 26 are brought into contact with left and right adjacent outer side guide walls 24*a* to be integrated with the outer side guide walls 24*a*. Thus, there is no gap between both left and right ends of the back side guide wall 26 and the left and right adjacent outer side guide walls 24*a*. In other words, parts of the back side guide wall 26 protruding from both left and right side surfaces of the inner side guide wall 24*b* overlap with the entire back surface of the constricted part 52*d* in the width direction of the connector 1. Thus, the displacement of the constricted part 52*d* toward the back side is prevented, whereby the displacement of the vertical part 52*c* of the leg part 52B toward the back side is prevented.

Other configurations are the same as those in the example illustrated in FIGS. 7 to 9B, and thus the description thereof is omitted.

The upper side terminal 51A, held by the upper side housing 11A in the connector 1 according to the present embodiment, has a tail part 52A of what is known as a surface mounting type that is connected to the connection pad formed on the surface of the board by soldering. The tail part 52A is bent at a part close to the lower surface of the upper side housing 11A by approximately 90 degrees to protrude toward the back side, and has a lower surface connected to the connection pad formed on the surface of the board by soldering. Thus, the tail part 52A is stably positioned with substantially no protrusion toward the lower side from the lower surface of the upper side housing 11A. Thus, no guide member is required.

On the other hand, the lower side terminal 51B, held by the lower side housing 11B, has a leg part 52B of what is known as dip type or pin insertion type that is mounted by soldering while having a lower end inserted into a through hole formed in the surface of the board. The leg part 52B, which largely protrudes from the back end 12*r* of the terminal holding part 12B, is guided by the guide member 21 integrally formed with the lower side housing 11B, and thus is stably positioned. Thus, downward protruding parts 52*e* of a plurality of the leg parts 52B protruding toward the lower side from the lower surface of the guide member 21 can each be accurately inserted into a corresponding one of the through holes.

It is practically impossible to embed a part of the leg part 52B from the horizontal part 52*a* to the upper end of the downward protruding part 52*e*, in the lower side housing 11B by over-molding. This is because a mold that can be opened without interfering with the plurality of downward protruding parts 52*e*, which need to have a predetermined protrusion length or more for the insertion into the through holes, is extremely difficult to manufacture.

The upper side terminal 51A may be modified to have the leg parts 52B of what is known as dip type or pin insertion type, as in the case of the lower side terminal 51B. In such a case, the upper side housing 11A can be modified to have the guide member 21 integrally formed, as in the case of the lower side housing 11B.

As described above, the connector 1 according to the present embodiment includes: the lower side housing 11B; the lower side terminals 51B that include the leg parts 52B to be connected to the board, and are integrally formed with the lower side housing 11B; and the guide members 21 that are integrally formed with the lower side housing 11B and guide the leg parts 52B. The leg parts 52B each include: the horizontal part 52*a* that protrudes toward the back side from the lower side housing 11B; the vertical part 52*c* with the downward protruding part 52*e* to be connected to the board; and the curved part 52*b* through which the horizontal part 52*a* and the vertical part 52*c* are connected with each other. The gap 23*a* is provided between the back surface 21*r* of the guide member 21 and the front surface 52*f* of the vertical part 52*c*. With this configuration, the curved part 52*b* can be formed with the vertical part 52*c*, more on the lower side than the lower end of the curved part 52*b*, displaced toward the front side. Thus, the curved part 52*b* can be accurately formed even when spring back occurs. Thus, this simple configuration can guarantee stabilization of the position of the leg part 52B, as well as cost reduction and higher reliability.

The inclined part 21*c* along which the gap 23 increases toward the lower side is formed on the back surface 21*r*. Thus, the vertical part 52*c* can be further displaced toward the front side for large spring back of the leg part 52B.

The guide members 21 include the guide walls 24 that protrude toward the back side from the back surface 21*r*, and the vertical part 52*c* is accommodated in the guide groove 23 between adjacent ones of the guide walls 24. The vertical part 52*c* is not in contact with at least one of the guide walls 24 on both sides of the guide groove 23. With this configuration, the displacement of the vertical part 52*c* in the width direction of the connector 1 can be prevented.

The guide member 21 includes the back side guide wall 26 that overlaps with at least a part of the back surface of the vertical part 52*c*, and prevents displacement of the vertical part 52*c* toward the back side. The back side guide wall 26 is integrally connected to one or both of the guide walls 24 on both sides of the guide groove 23. This ensures the prevention of the displacement of the vertical part 52*c*.

Next a second embodiment will be described. Note that the description of objects having the same structures as those of the first embodiment will be omitted by being denoted by the same reference numerals. Furthermore, the description of operations and effects that are the same as those of the first embodiment will be omitted.

Figure 13B:
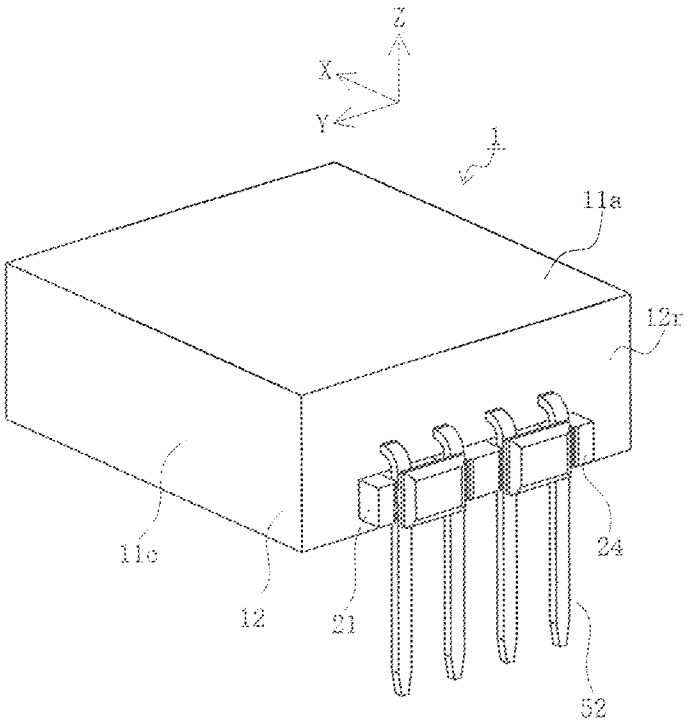
FIGS. 13A and 13B are perspective views of a connector according to a second embodiment.
Figure 13A:
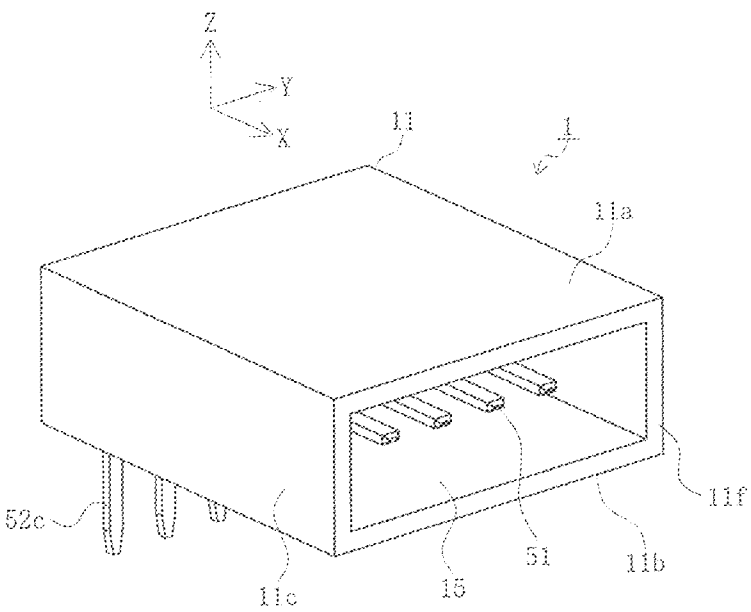
Figure 14B:
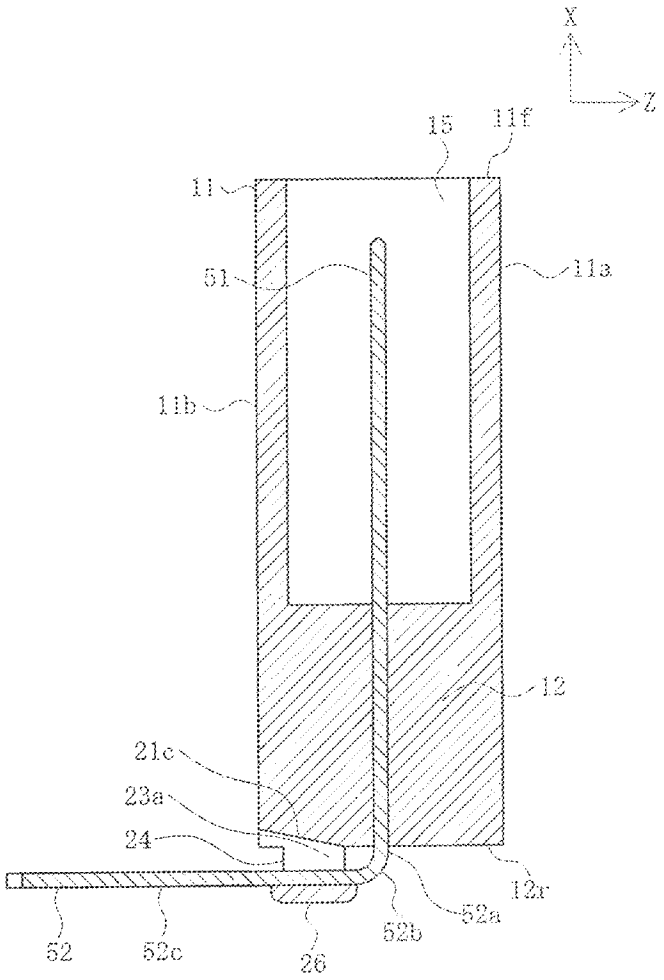
FIGS. 14A and 14B illustrates two views of the connector according to the second embodiment.
Figure 14A:
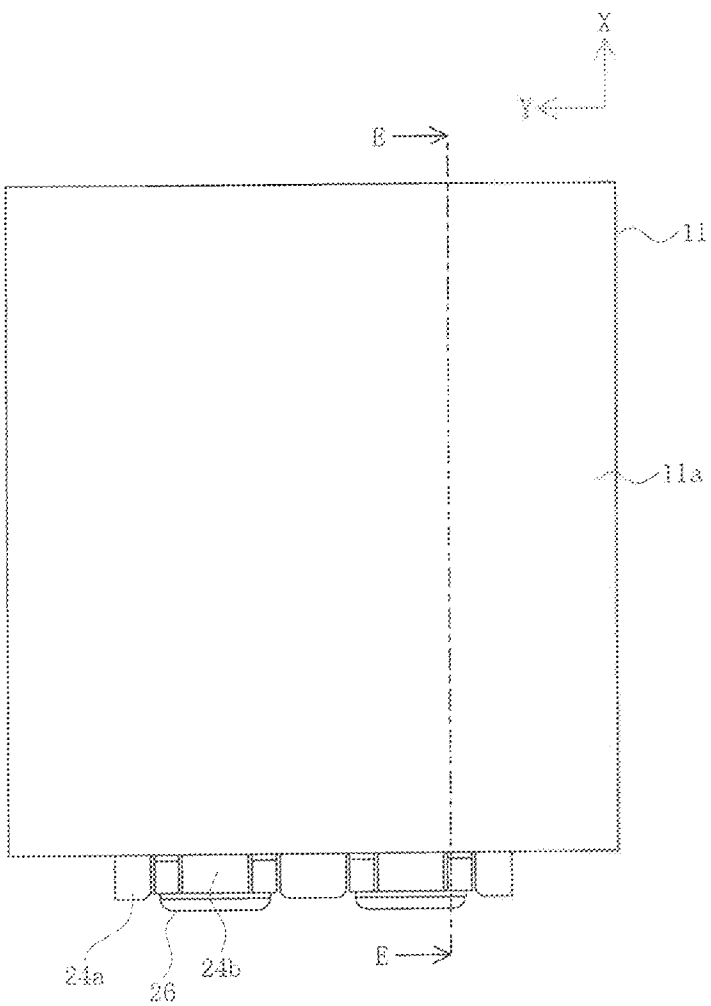
Figure 15:
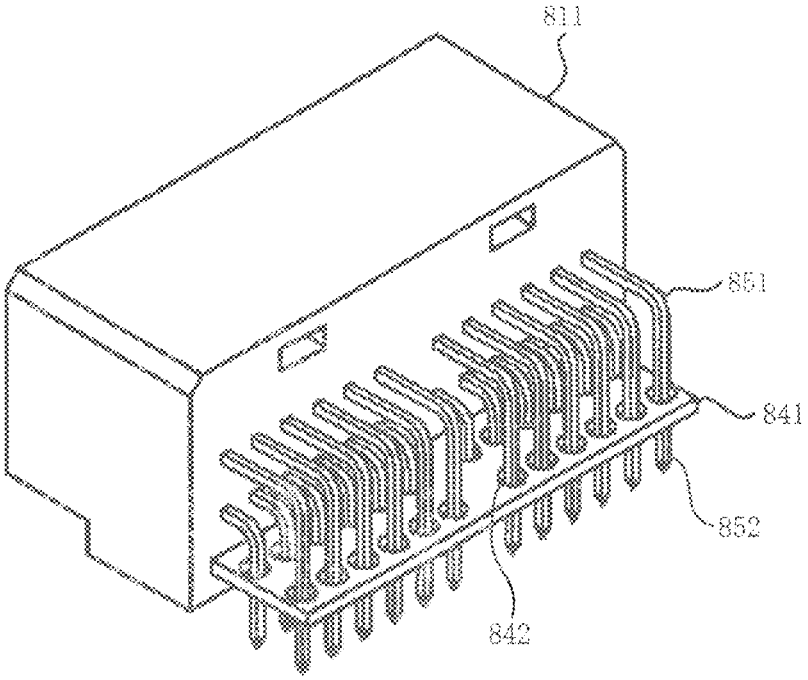
FIG. 15 Prior Art
FIG. 15 is a perspective view illustrating a conventional board connector as viewed from the back side.

FIGS. 13A and 13B are perspective views of a connector according to a second embodiment. FIGS. 14A and 14B illustrate two views of the connector according to the second embodiment. Note, FIG. 13A is a perspective view as viewed from the front side and FIG. 13B is a perspective view as viewed from the back side, and FIG. 14A is a top view and FIG. 14B is a cross-sectional view in a direction of arrow E-E in FIG. 14A.

The connector 1 according to the present embodiment is a board connector mounted to an unillustrated board, as in the first embodiment. The connector 1 according to the present disclosure does not include the shell 61, and the housing 11 has a surface exposed. The housing 11 has a substantially rectangular parallelepiped outer shape, and has an inner cavity 15 that opens at a front end 11*f*. The inner cavity 15 functions as an insertion recess into which a protruding part of an unillustrated mating connector is inserted. The housing 11 has a top plate part 11*a*, a bottom plate part 11*b*, and a pair of side plate parts 11*c* defining the circumference of the inner cavity 15.

The housing has a back part serving as the terminal holding part 12 that holds the terminal 51 and has the back end 12*r* from which the leg parts 52 of the terminal protrudes toward the back side. The terminal holding part 12 further includes the guide member 21 that protrudes toward the back side from the back end 12*r*.

The housing 11 according to the present embodiment is not divided into upper and lower sections and has no tongue part. The terminal 51 is also not divided into upper and lower sides. Thus, the terminals 51 are aligned in a single row along the width direction of the connector 1, in the inner cavity 15.

In the present embodiment, the terminal 51 is bent by approximately 90 degrees, to protrude toward the lower side, as in the case of the lower side terminal 51B according to the first embodiment, and is connected by soldering while having the lower end inserted into a through hole of the unillustrated board. The vertical parts 52*c* of the leg parts 52 of the terminal 51 are aligned in a single row along the width direction of the connector 1. The leg part 52 is guided by the guide member 21.

Other configurations of the connector 1 are the same as those in the first embodiment, and thus the description thereof is omitted.

An effect provided by the connector 1 is the same as that in the first embodiment, and thus the description thereof is omitted.

Note that the present disclosure is only one example, and thus any appropriate change that preserves the gist of the present disclosure and can easily be conceived by a person skilled in the art is within the scope of the present disclosure. The widths, thicknesses, and shapes of the parts illustrated in the drawing are illustrated schematically and are not intended to limit the interpretation of the present disclosure.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to connectors.

The invention claimed is:

1. A connector comprising:

a housing; terminals that include leg parts to be connected to a board, and are integrally formed with the housing; and guide members that are integrally formed with the housing and guide the leg parts, wherein the leg parts each include: a horizontal part that protrudes toward a back side from the housing; a vertical part having a part around a distal end to be connected to the board; and a curved part through which the horizontal part and the vertical part are connected with each other, and a gap is provided between a back surface of the guide member and a front surface of the vertical part.

2. The connector according to claim 1, wherein an inclined part along which the gap increases toward a lower side is formed on the back surface.

3. The connector according to claim 1, wherein the guide members include guide walls that protrude toward the back side from the back surface, and the vertical part is accommodated in a guide groove between adjacent ones of the guide walls.

4. The connector according to claim 3, wherein the vertical part is not in contact with at least one of the guide walls on both sides of the guide groove.

5. The connector according to claim 3, wherein the guide members each include a guide plate that overlaps with at least a part of the back surface of the vertical part, and prevents displacement of the vertical part toward the back side.

6. The connector according to claim 5, wherein the guide plate is integrally connected to one of the guide walls on both sides of the guide groove.

7. The connector according to claim 5, wherein the guide members are integrally connected to both of the guide walls on both sides of the guide groove.

8. A connector assembly comprising:

the connector according to claim 1; and a mating connector including a mating terminal to be connected to the terminals.

* * * * *